United States Patent [19]

Mudge

[11] Patent Number: 4,740,394

[45] Date of Patent: Apr. 26, 1988

[54] TEXTILE COATINGS BASED ON EVA-MALEATE COPOLYMERS

[75] Inventor: Paul R. Mudge, Somerville, N.J.

[73] Assignee: National Starch and Chemical Corporation, Bridgewater, N.J.

[21] Appl. No.: 905,351

[22] Filed: Sep. 8, 1986

[51] Int. Cl.[4] ..... B05D 3/02

[52] U.S. Cl. ..... 427/389.9; 524/555

[58] Field of Search ..... 427/389.9; 428/95, 96, 428/532; 524/555

[56] References Cited

U.S. PATENT DOCUMENTS

| | | | |
|---|---|---|---|
| 2,965,617 | 12/1960 | MacDonald et al. | 260/78.5 |
| 3,337,482 | 8/1967 | Watanabe et al. | 260/8 |
| 3,345,318 | 10/1967 | Lindemann et al. | 260/29.6 |
| 3,483,171 | 12/1969 | Kuhlkamp et al. | 260/80.6 |
| 3,501,440 | 3/1970 | Kamio et al. | 260/77.5 |
| 3,639,326 | 2/1972 | Kray et al. | 260/29.6 |
| 3,657,174 | 4/1972 | Glabisch et al. | 260/29.6 |
| 3,708,444 | 1/1973 | Ganzler et al. | 260/2.5 |
| 3,714,096 | 1/1973 | Biale | 524/555 |
| 3,734,870 | 5/1973 | Schroeder et al. | 260/2.5 |
| 3,755,237 | 8/1973 | Isaacs et al. | 526/324 |
| 3,823,108 | 7/1974 | Bissot et al. | 260/27 R |
| 3,900,663 | 8/1975 | Barabas et al. | 427/389.9 |
| 3,923,752 | 12/1975 | Guse et al. | 260/78.5 E |
| 3,933,691 | 1/1976 | Lindemann | 260/2.5 L |
| 3,950,302 | 4/1976 | Rauterkus | 524/555 |
| 4,001,158 | 1/1977 | Lindemann | 260/29.6 TA |
| 4,044,197 | 8/1977 | Wiest et al. | 526/304 |
| 4,187,353 | 2/1980 | Schroeder | 521/149 |
| 4,239,563 | 12/1980 | Iacovielle | 524/555 |
| 4,322,516 | 3/1982 | Wiest et al. | 526/307.7 |
| 4,446,274 | 5/1984 | Okazaki et al. | 524/812 |
| 4,510,274 | 4/1985 | Okazaki et al. | 523/411 |
| 4,542,182 | 9/1985 | Schuppiser et al. | 524/563 |
| 4,610,920 | 9/1986 | Mudge et al. | 428/288 |

FOREIGN PATENT DOCUMENTS

| | | | |
|---|---|---|---|
| 1123879 | 10/1966 | United Kingdom . | |
| 1188635 | 4/1970 | United Kingdom | 526/324 |

OTHER PUBLICATIONS

CA96(22)184028b; Chemical Abstract; Sanyo Chemical Industries, Ltd., Patent Application JP 56/167791, "Low-temperature Flow Improvers".

CA102(8):64744c; Chemical Abstract: Mitsubishi Electric Corp., Patent Application JP 59/138695, "Pour Point Depressants for Crude Petroleum".

*Primary Examiner*—Thurman K. Page

*Assistant Examiner*—L. R. Horne

*Attorney, Agent, or Firm*—Ellen T. Dec; Edwin M. Szala

[57] ABSTRACT

Woven pile fabrics, particularly upholstery fabrics and corduroy, characterized by a superior balance of strength and softness are back-coated utilizing an aqueous emulsion prepared by the emulsion polymerization of a vinyl ester of an alkanoic acid interpolymerized with 10 to 30% by weight ethylene; 15 to 40% by weight of a $C_4$-$C_{10}$ dialkyl maleate; to 5% by weight of copolymerizable N-methylol containing monomer; 0 to 4% by weight of an olefinically unsaturated carboxylic acid and 0 to 1% by weight of a polyethylenically unsaturated comonomer.

9 Claims, No Drawings

TEXTILE COATINGS BASED ON EVA-MALEATE COPOLYMERS

BACKGROUND OF THE INVENTION

Coatings, backcoatings and finishes are applied to pile type woven fabrics such as corduroy, tufted upholstery, etc., for a variety of reasons, in particular to stabilize the fibers during processing as well as to produce a fabric of improved hand, integrity, pile retention, durability and abrasion resistance to the face of the fabric. In most cases, it is important that the coating be durable under laundering conditions. In particular, these woven-pile fabrics have an extra set of warp or filling yarns interlaced with the basic fabric in such a manner that loops or cut ends are produced on the surface of the fabric. If the resultant loosely bound fibers are not backcoated with an adhesive or binder, the pile will not remain in the fabric during subsequent processing and certainly not after any subsequent laundering.

The introduction of N-methylol containing comonomers into the latex polymers used as binders in these backcoatings has been proposed in order to improve their laundering durability properties. N-methylol containing acrylic latices have generally been used as binders where softness is the most important criteria, to give a good balance of softness and strength, especially in the areas of pluck strength, seam slippage, pile retention and abrasion resistance, however these acrylic binders are relatively high in cost. More economical properties such as ethylene/vinyl acetate-based binders containing N-methylol comonomers such as are disclosed in U.S. Pat. No. 3,380,851 issued Apr. 30, 1968 to M. K. Lindemann et al., yield the necessary strength properties but are deficient in the areas of softness and drape.

SUMMARY OF THE INVENTION

We have found that latex binders for use in back coating pile fabrics can be prepared by the emulsion polymerization of a vinyl ester of an alkanoic acid interpolymerized with 10 to 30% by weight ethylene; 15 to 40% by a weight of a $C_4$–$C_{10}$ dialkyl maleate; 1 to 5% by weight of a copolymerizable N-methylol containing monomer; 0 to 4% by weight of an olefinically-unsaturated carboxylic acid containing 3 to 6 carbon atoms and 0 to 1% by weight of a polyolefinically unsaturated comonomer; the total of the aforementioned comonomers equalling 100% by weight.

Surprisingly, pile fabrics coated with these binders possess the desirable softness characteristic of binders containing high acrylate content, combined with improvements in the areas of pluck strength, abrasion resistance, seam slippage and pile retention.

DESCRIPTION OF THE PREFERRED EMBODIMENTS

The vinyl esters utilized herein are the esters of alkanoic acids having from one to about 13 carbon atoms. Typical examples include: vinyl formate, vinyl acetate, vinyl propionate, vinyl butyrate, vinyl isobutyrate, vinyl valerate, vinyl 2-ethyl-hexanoate, vinyl isooctanoate, vinyl nonoate, vinyl decanoate, vinyl pivalate, vinyl versatate, etc. Of the foregoing, vinyl acetate is the preferred monomer because of its ready availability and low cost.

The N-methylol component is generally N-methylol acrylamide although other mono-olefinically unsaturated compounds containing an N-methylol group and capable of copolymerizing with ethylene and the vinyl ester may also be employed. Such other compounds include, for example, N-methylol methacrylamide or lower alkanol ethers thereof, or mixtures thereof.

The dialkyl maleate monomers used herein include the $C_4$ to $C_{10}$ dialkyl maleates such as di-2-ethyhexyl maleate, di-n-octyl maleate, di-iso-octyl maleate, dimethylamyl maleate, di-butyl maleate and di-iso-decyl maleate. Particularly preferred are the $C_6$–$C_{10}$ dialkyl maleates and more particularly the $C_8$ dialkyl maleates. Due to its commercial availability di-2-ethylhexyl maleate is most generally used. Since, after polymerization, the structure of the fumarate and maleate (cis and trans isomers) are the same, the corresponding fumarate esters are also contemplated for use herein. While amounts of the dialkyl maleate in excess of about 15% are beneficial, levels of at least about 20% are preferred.

The olefinically-unsaturated carboxylic acids which may optionally be present, are the alkenoic acids having from 3 to 6 carbon atoms or the alkenedioic acids having from 4 to 6 carbon atoms, like acrylic acid, methacrylic acid, crotonic acid, itaconic acid, maleic acid or fumaric acid, or mixtures thereof in amounts sufficient to provide up to about 4% by weight, preferably 1 to 2.5 of monomer units in the final copolymer.

Optionally, polyunsaturated copolymerizable monomers may also be present in small amounts, i.e., up to about 1% by weight. Such comonomers would include those polyolefinically-unsaturated monomers copolymerizable with vinyl acetate and ethylene, for example, vinyl crotonate, allyl acrylate, allyl methacrylate, diallyl maleate, divinyl adipate, diallyl adipate, diallyl phthalate, ethylene glycol diacrylate, ethylene glycol dimethacrylate, butanediol dimethacrylate, methylene bis-acrylamide, triallyl cyanurate, etc. In addition, certain copolymerizable monomers which assist in the stability of the copolymer emulsion, e.g., 2-acrylamide-2-methylpropane sulfonic acid and vinyl sulfonic acid, are also useful herein as latex stabilizers. These optionally present monomers, if employed, are added in very low amounts of from 0.1 to about 2% by weight of the monomer mixture.

Conventional batch, semi-batch or continuous emulsion polymerization procedures may be utilized herein. Generally, the monomers are polymerized in an aqueous medium under pressures not exceeding 100 atmospheres in the presence of a catalyst and at least one emulsifing agent.

The quantity of ethylene entering into the copolymer is influenced by the pressure, the agitation, and the viscosity of the polymerization medium. Thus, to increase the ethylene content of the copolymer, higher pressures are employed. A pressure of at least about 10 atmospheres is most suitable employed. The mixture is thoroughly agitated to dissolve the ethylene, agitation being continued until substantial equilibrim is achieved. This generally requires about 15 minutes; however, less time may be required depending upon the vessel, the efficiency of agitation, the specific system, and the like.

Suitable as polymerization catalysts are the water-soluble free-radical-formers generally used in emulsion polymerization, such as hydrogen peroxide, sodium persulfate, potassium persulfate and ammonium persulfate, as well as tert-butyl hydroperoxide, in amounts of between 0.01 and 3% by weight, preferably 0.01 and 1% by weight based on the total amount of the emulsion. They can be used alone or together with reducing agents such as sodium formaldehyde-sulfoxylate, iron-II-salts, sodium dithionite, sodium hydrogen sulfite, sodium sulfite, sodium thiosulfate, as redox catalysts in amounts of 0.01 to 3% by weight, preferably 0.01 to 1% by weight, based on the total amount of the emulsion. The free radical-formers can be charged in the aqueous emulsifier solution or be added during the polymerization in doses.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkai metal phosphates. Polymerization regulators, like mercaptans, aldehydes, chloroform, methylene chloride and trichloroethylene, can also be added in some cases.

The dispersing agents are all the emulsifiers generally used in emulsion polymerization, as well as optionally present protective colloids. It is also possible to use emulsifiers along or in mixtures with protective colloids.

The emulsifiers can be anionic, cationic or nonionic surface active compounds. Suitable anionic emulsifiers are, for example, alkyl sulfonates, alkylaryl sulfonates, alkyl sulfates, sulfates of hydroxylalkanols, alkyl and alkylaryl disulfonates, sulfonated fatty acids, sulfates and phosphates of polyethoxylated alkanols and alkylphenols, as well as esters of sulfosuccinic acid. Suitable cationic emulsifiers are, for example, alkyl quaternary ammonium salts, and alkyl quaternary phosphonium salts. Examples of suitable non-ionic emulsifiers are the addition products of 5 to 50 mols of ethylene oxide adducted to straight-chained and branch-chained alkanols with 6 to 22 carbon atoms, or alkylphenols, or higher fatty acids, or higher fatty acid amides, or primary and secondary higher alkyl amines; as well as block copolymers of propylene oxide with ethylene oxide and mixtures thereof. When combinations of emulsifying agents are used, it is advantageous to use a relatively hydrophobic emulsifying agent in combination with a relatively hydrophilic agent. The amount of emulsifying agent is generally from about 1 to 10, preferably from about 2 to about 8, weight percent of the monomers used in the polymerization.

The emulsifier used in the polymerization can also be added in its entirety to the initial charge to the polymerization zone or a portion of the emulsifier, e.g., from 25 to 90 percent thereof, can be added continuously or intermittently during polymerization.

Various protective colloids may also be used in place of or in addition to the emulsifiers described above. Suitable colloids include partially acetylated polyvinyl alcohol, e.g., up to 50 percent acetylated, casein, hydroxyethyl starch, carboxymethyl cellulose, gum arabic, and the like, as known in the art of synthetic emulsion polymer technology. In general, these colloids are used at levels of 0.05 to 4% by weight based on the total emulsion.

The polymerization reaction is generally continued until the residual vinyl acetate monomer content is below about 1%. The completed reaction product is then allowed to cool to abour room temperature, while sealed from the atmosphere.

The emulsions are produced and used at relatively high solids contents, e.g., between 35 and 70%, preferably not less than 50%, although they may be diluted with water if desired.

The particle size of the latex can be regulated by the quantity of nonionic or anionic emulsifying agent or protective colloid employed. To obtain smaller particles sizes, greater amounts of emulsifying agents are used. As a general rule, the greater the amount of the emulsifying agent employed, the smaller the average particle size.

The copolymers according to the invention have a glass transition temperature of between −45° to −20° C. and dry to form soft flexible films. They are generally crosslinked in a weakly acid pH range or in the presence of latent acid catalysts at elevated temperature. The optimum crosslinking temperatures are between 100° and 200° C., preferably between 130° and 160° C. Acid catalysts accelerate the crosslinking. Such acid catalysts are mineral acids or organic acids, such as phosphoric acid, tartaric acid, citric acid, or acid salts, such as chromium -III salts, aluminum chloride, ammonium chloride, zinc nitrate or magnesium chloride.

The vinyl acetate-ethylene-maleate-N-methylol containing backcoating described above is suitably used to prepare woven pile fabrics by a variety of methods known to the art which, in general, involve the impregnation of a loosely assembled web of fibers which remain after cutting of the wove tufts to form the pile, followed by moderate heating to dry the web and cure the coating. The specific composition of the backcoating formulation as well as the method of application varies depending upon the type of fabric to be coated and the end use thereof.

Backcoatings formulated for pile upholstery fabrics are usually utilized at relatively high solids levels and are generally combined with substantial amounts of inert fillers such as clay, aluminum hydrate, silica, calcium carbonate, etc. These fillers are employed in amounts up to about 150 parts by weight per 100 parts of the dry binder to which remain after cutting of the woven tufts to form the pile, provide a viscosity of about 5,000 to 10,000 cps. These pile upholstery binders may also have incorporated therein an N-methylol containing thermoset polymer to improve the strength of the overall binder. This may be accomplished by replacing 0.5 to 5% by weight of the latex binder solids with an N-methylol containing thermoset polymer. Typical examples of these thermoset polymers are monoethylolmelamine, dimethylolmelamine, trimethylolmelamine, tetramethylolmelamine, pentamethylolmelamine, hexamethylolmelamine, N-methoxymethyl N'-methylolmelamine, dimethylolethylene urea, monomethylol urea, dimethylol urea, dimethylolethyltriazone, dimethylolhydroxyethyltriazone, tetramethylolacetylene diurea, dimethylolpropylene urea, dimethyloldihydroxyethylene urea, N-butoxymethyl N-methylol urea and N-methoxymethyl N-methylol urea.

In the situation where the upholstery binders are to be applied utilizing foaming techniques, they are adjusted to an alkaline pH and foaming agents added hereto. The foaming agents which may be used herein are generally the water soluble salts of aliphatic carboxylic acids containing 16 to 20 carbon atoms, preferably those of the 18 carbon atom acids, representative of which are the alkali metal, ammonium or amine salts of stearic acid, tallow fatty acids and oleic acid. Most commonly employed is ammonium stearate. The foaming agents, if used, are present in amounts of 1 to 10%, preferably 2 to 8%, by weight of the adhesive solids.

The binders disclosed herein may also be used in the manufacture of corduroy where the pile retention, strength requirements, abrasion resistance, and wash durability are high yet a soft hand is desired. Binders for use in corduroy pile fabrics, are generally diluted with water and utilized at about 20 to 30% solids levels. When used in this application, fillers are not present, however other known additives including permanent press resins, softeners, etc. are commonly employed.

Additionally, there may also be present in any of the latex binders of the invention other additives conventionally employed in similar binders including auxiliary foaming agents, foam stabilizers, defoamers, pigments, catalysts, wetting agents, thickeners, external plasticizers, etc. The choice of materials as well as the amounts employed are well known to those skilled in the art. These materials may be added just before application, if their stability in the dispersion or solution is low, or they may be formulated into the aqueous dispersion of the binder and stored if the stability in aqueous dispersion is high. Further, before these binders are applied they are optionally mixed with a suitable catalyst for the N-methylol groups present. Thus, acid catalysts such as mineral acids, e.g. HCl, or organic acids, e.g., oxalic acid, or acid salts such as ammonium chloride, are suitably used, as known in the art. The amount of catalyst is generally about 0.5 to 2% of the total resin.

As previously discussed, the latex binders of the invention may be readily applied to a woven fabric to provide a backcoating or similar coating which will give a balance of softness and strength characteristics to the fabric, particularly in the areas of pile retention and abrasion resistance. In the case of the foamable latices, the preferred method for application is via knife coating after which the latex is partially dried and may, or may not, be crushed depending on the end use of the coated fabric. Foamed techniques are more commonly utilized in binders formulated for pile upholstery fabrics while kiss coating techniques involving passing the fabric over a roller in a binder bath is generally used for corduroy.

The backcoatings may be applied to woven fabrics formed from a wide range of natural or synthetic fibers including cotton, wool, linen, cellulose acetate, nylon, rayon, polyester and mixtures thereof. The rate of application can be readily controlled in known manner and the quantity applied to the fabric will depend upon individual conditions and the individual fabric being treated. Ordinarily, for use as a backcoating for pile upholstery, the latex is applied at such a rate that the solids content of the coating is of the order of 5–6% based on the weight of the fabric while for corduroy finishes, add-on binder levels of 2.5 to 10% of the dry weight of the fabric are used. The solids content of the latex itself can also vary, but it is generally advantageous to have a solids content of the order of 50% for upholstery and 10–20% for corduroy. If the latex, as produced, has a higher solids content, or if an even lower solids content is desired, the appropriate solids content can readily be attained by appropriate dilution of the latex with water.

After the coating has been applied, the fabric is subjected to a drying stage and a curing stage. The drying is ordinarily carried out at a temperature in the range of 150° to 155° C. for a period of time of the order of 3 minutes. However, other time-temperature relationship can be employed, as is well known in the art, shorter times at higher temperatures or longer times at lower temperatures being used. For example, the curing step can be carried out at 140° C. for about 15 min. or more. However, economic considerations make the use of excessively long times undesirable, and the upper temperature limit is governed by the nature of the fabric. Temperatures which degrade the fabric are, of course, avoided. If the fabrics are heat resistant, temperatures as high as 175° C. or higher can be used with the times of 5–10 min. or more. If desired, the drying and curing can be effected in a single exposure or step, e.g. at 150° C. for 5–10 min. In the curing, the N-methylol acrylamide completes its polymerization and cross-links in the resin. To facilitate this post-polymerization, the latex has mixed with it, before it is applied to fabric, a suitable catalyst for the N-methylol acrylamide. Thus, acid catalysts such as mineral acids, e.g. HCl, or organic acids, e.g. oxalic acid, or acid salts such as ammonium chloride or magnesium chloride are suitable used, as known in the art. The amount of catalyst is generally about 0.5 to 2% of the total resin.

The following examples are given to illustrate the present invention, but it will be understood that they are intended to be illustrative only and not limitative of the invention. In the examples, all parts are by weight unless otherwise indicated.

EXAMPLE I

To a 10 liter autoclave was charged 675 g. (of a 20% w/w solution in water) sodium alkyl aryl polyethylene oxide sulphate (3 moles ethylene oxide), 50 g. (of a 70% w/w/ solution in water) alkyl aryl polyethylene oxide (30 moles ethylene oxide) 60 g. (of a 25% w/w solution in water) sodium vinyl sulphonate, 0.5 g. sodium acetate, 2 g. sodium formmaldehyde sulphoxylate, 5 g. (of a 1% w/w solution in water) ferrous sulphate solution and 1900 g. water. After purging with nitrogen, 2250 g. vinyl acetate and 750 g. di-2-ethylhexyl maleate were charged to the reactor. The reactor was then pressurized to 750 psi with ethylene and equilibrated at 50° C. for 15 minutes. The polymerization was then started by metering in a solution of 60 g. tertiary buty hydroperoxide in 200 g. water and 45 g. sodium formaldehyde solphoxylate and 2 g. sodium acetate in 225 g. water over a period of 5 hrs. uniformly. Also added over 4 hrs. was a solution of 150 g. of N-methylol acrylamide (49% solution in water) and 75 g. of acrylic acid in a total of 250 g. of water.

Once the addition of the initiators was started, the reaction temperature was raised to 80°–82° C. and kept at this temperature until the reaction was completed. At the end of the initiator slow additions, the product was transferred to an evacuated vessel (30 liter) to remove residual ethylene from the system. It was identified as Emulsion 1.

Using the general procedure described above, additional emulsions were prepared varying the amounts and/or monomeric compositions. The major monomers and their respective amounts by weight are shown in Table I.

TABLE I

| Emulsion No. | VA | DEHM | DBM | E | NMA | AA |
|---|---|---|---|---|---|---|
| 1 | 60 | 20 | — | 20 | 2 | 2 |
| 2 | 50 | 30 | — | 20 | 2 | 2 |
| 3 | 62.5 | — | 17.5 | 20 | 3 | — |

TABLE I-continued

| Emulsion No. | VA | DEHM | DBM | E | NMA | AA |
|---|---|---|---|---|---|---|
| 4 | 40 | — | 40 | 20 | 3 | — |

Monomer Key:
VA = Vinyl Acetate
E = Ethylene
DEHM = Di-2-Ethylhexylmaleate
NMA = N—Methylol Acrylamide
DBM = Di-n-butyl Maleate
AA = Acrylic Acid Emulsions 1–4 were evaluated as a backcoating for corduroy using the following formulation:

| Ingredients | Parts by Weight (Wet) |
|---|---|
| Polymer @ 50% Solids | 150.0 |
| Acid Catalyst | 10.0 |
| Wetting Agent | 2.0 |
| Water | 838.0 |
| Total | 1,000.0 |

The backcoatings were coated on the corduroy at wet pickup levels of 60%, dried for 1 minute at 175° C. and cured for 2 minutes at 150° C. The coated fabric was then tested using the following procedures.

Pile Retention Testing:

This test measures the ability of the backcoating to retain pile yarns during abrasive or rubbing type actions. A Tabor Abrasion Tester with a CS-10 wheel for 100, 300, 500, and 700 cycles was utilized. A rating of 5.0 is equal to no pile loss while a rating of 1.0 indicates complete pile loss. A rating 3.0 is considered average/-satisfactory at 100 cycles with a rating of 4.0 desired. Samples were tested before and after three home laundering cycles.

% Fiber Loss:

This test is used in conjunction with pile retention ratings to measure durability to abrasive/rubbing type actions. Samples are weighed before and after abrasion testing with the weight loss divided by the original sample wt. times 100 as the % Fiber Loss.

Hand:

The purpose of this test is to determine the hand feel of each sample in terms of softness. Samples were compared to each other and ranked in order of softness, with 5.0 being the softest. Rating is subjective using a panel of 2 or 3 people. The softest hand possible is desired.

The results of the testing are shown in Table II.

TABLE II

| Emulsion | Fiber % Loss | Pile Retention Ratings (Cycles) 100 | 300 | 500 | 700 | Hand |
|---|---|---|---|---|---|---|
| 1 | 0.04 | 5.0 | 5.0 | 5.0 | 4.5 | 2.0 |
| 2 | 0.17 | 5.0 | 5.0 | 4.5 | 4.0 | 3.5 |
| 3 | 0.81 | 5.0 | 4.5 | 4.5 | 4.0 | 2.0 |
| 4 | 0.71 | 5.0 | 4.5 | 4.5 | 4.0 | 3.0 |
| A | 0.30 | 5.0 | 4.5 | 4.5 | 4.5 | 4.0 |
| After 3 home laundry cycles: | | | | | | |
| 1 | 0.75 | 5.0 | 4.0 | 3.5 | 3.5 | 2.0 |
| 2 | 1.94 | 4.5 | 2.5 | 2.0 | 2.0 | 3.5 |
| 3 | 1.54 | 4.5 | 3.5 | 3.0 | | 2.0 |
| 4 | 1.38 | 4.5 | 3.5 | 3.0 | 3.0 | 3.0 |
| A | 0.84 | 4.5 | 4.0 | 3.5 | 3.5 | 4.0 |

A = Commercially used "soft" all acrylic ($T_g$ = −25° C., NMA = 3)

The results of Table II show that the use of the emulsion of the present invention as backcoating in the production of corduroy pile fabrics provides generally equal or superior strength and durability properties as compared to the acrylic controls with only slight reduction in softness but with substantial reduction in raw material cost. In particular, samples 2 and 4 containing higher maleate levels are most useful for applications where softness is the prime consideration while samples 1 and 3 are preferred for applications where durability is the prime factor.

Similar results would be obtained using binders prepared with other maleates in the $C_4$–$C_{10}$ range such as well as the corresponding fumarates.

A similar balance of softness and strength properties would be achieved using the emulsions prepared above in formulations containing fillers, optional foaming agents and/or post-added thermosets as are adapted for backcoating of pile upholstery fabric.

It will be apparent that various changes and modifications may be made in the embodiments of the invention described above, without departing from the scope of the invention, as defined in the appended claims, and it is intended therefore, that all matter ontained in the foregoing description shall be interpreted as illustrative only and not as limitative of the invention.

We claim:

1. A method for backcoating woven-pile fabrics having an extra set of warp or filling yarns interlaced with the fabric in such a manner that loops or cut ends are produced on the surface of the fabric which comprises the steps of:

(I) applying to the fabric an aqueous emulsion prepared by the emulsion polymerization of:

(a) a vinyl ester of an alkanoic acid having 1 to 13 carbon atoms interpolymerized with the following comonomers:

(b) 10 to 30% by a weight of ethylene;

(c) 15 to 40% by weight of a $C_4$–$C_{10}$ dialkyl maleate or the corresponding fumarate; and (d) 1 to 5% by weight of N-methylol acrylamide or N-methylol methacrylamide;

the vinyl ester being added in an amount to total 100%;

and (II) heating to dry the web and cure the backing.

2. The method of claim 1 wherein the vinyl ester in the emulsion is vinyl acetate.

3. The method of claim 1 wherein the dialkyl maleate in the emulsion is present in an amount of at least 20% by weight.

4. The method of claim 1 wherein the emulsion additionally contains an acid catalyst selected from the group consisting of mineral acids, organic acids and acid salts in an amount of 0.5 to 2% by weight of the emulsion polymer solids.

5. The method of claim 1 wherein the emulsion additionally contains 1 to 4% by weight of an olefinically unsaturated acid selected from the group consisting of acrylic acid, methacrylic acid, crotonic acid, itaconic acid, maleic acid and fumaric acid.

6. The method of claim 5 wherein the olefinically unsaturated carboxylic acid in the emulsion is present in an amount of 1 to 2.5% by weight.

7. The method of claim 5 wherein the dialkyl maleate in the emulsion is a $C_6$–$C_{10}$ dialkyl maleate.

8. The method of claim 7 wherein the dialkyl maleate in the emulsion is a $C_8$ dialkyl maleate.

9. The method of claim 1 wherein the emulsion additionally contains 0.1 to 1% by weight of a polyethylenically unsaturated comonomer selected from the group consisting of vinyl crotonate, allyl acrylate, allyl methacrylate, diallyl maleate, divinyl adipate, diethyl adipate, dialkyl phthalate, ethylene glycol diacrylate, ethylene glycol dimethacrylate, butanediol dimethacrylate, methylene bis-acrylamide and triallyl cyanurate.

* * * * *